US007538646B2

(12) United States Patent
Mikl

(10) Patent No.: US 7,538,646 B2
(45) Date of Patent: May 26, 2009

(54) RELAY WITH REDUCED LEAKAGE CURRENT

(75) Inventor: Rudolf Mikl, Arbesthal (AT)

(73) Assignee: Tyco Electronics Austria GmbH, Vienna (AT)

( * ) Notice: Subject to any disclaimer, the term of this patent is extended or adjusted under 35 U.S.C. 154(b) by 157 days.

(21) Appl. No.: 11/675,247

(22) Filed: Feb. 15, 2007

(65) Prior Publication Data

US 2007/0194866 A1 Aug. 23, 2007

(30) Foreign Application Priority Data

Feb. 18, 2006 (DE) ..... 10 2006 007 603

(51) Int. Cl.
*H01H 51/22* (2006.01)

(52) U.S. Cl. ..... 335/78; 335/18; 335/71; 335/93; 335/121; 335/165; 335/185; 335/19; 335/20; 335/21; 335/186; 335/187; 335/188; 335/189; 335/190; 335/191; 335/192

(58) Field of Classification Search ..... 335/18–21, 335/71, 78, 93, 121, 165, 185–192
See application file for complete search history.

(56) References Cited

U.S. PATENT DOCUMENTS 5,801,608 A * 9/1998 Mader ..... 335/128
5,844,456 A * 12/1998 Mader ..... 335/78
6,781,489 B2 * 8/2004 Shima et al. ..... 335/78
7,106,154 B2 * 9/2006 Takano et al. ..... 335/129
2003/0102944 A1 * 6/2003 Leopold et al. ..... 335/18

FOREIGN PATENT DOCUMENTS

| | | |
|---|---|---|
| DE | 7936040 | 3/1980 |
| DE | 35 30 267 A1 | 3/1987 |
| DE | 39 38 226 C1 | 5/1991 |
| DE | 38 08 558 C2 | 9/1991 |
| DE | 196 06 883 C1 | 4/1997 |

* cited by examiner

*Primary Examiner*—Lincoln Donovan
*Assistant Examiner*—Mohamad A Musleh
(74) *Attorney, Agent, or Firm*—Barley Snyder LLC

(57) ABSTRACT

A relay includes a magnetic system provided with an armature and a contact system provided with a first contact and a moveable second contact. An electrically insulating base plate is arranged between the magnetic system and the contact system and has an opening therein. First and second walls extend from the base plate and are arranged between the opening and the magnetic system or the opening and the contact system. An actuator extends between the armature and the contact system through the opening and transfers movement of the armature to the second contact to move the second contact into electrical engagement with the first contact. The actuator has a third wall that extends toward the base plate and between the first and second walls. The first, second, and third walls extend a leakage path of an electrical leakage current between the contact system and the magnetic system.

17 Claims, 5 Drawing Sheets

RELAY WITH REDUCED LEAKAGE CURRENT

CROSS-REFERENCE TO RELATED APPLICATIONS

This application claims the benefit of the filing date under 35 U.S.C. § 119(a)-(d) of German Patent No. DE 10 2006 007 603.6, filed Feb. 18, 2006.

FIELD OF THE INVENTION

The invention relates to a relay having a contact system and a magnetic system divide by a base plate of a housing wherein the base plate includes at least a first wall that extends a leakage path for a leakage current between the contact system and the magnetic system.

BACKGROUND

Electromagnetic relays are used in the most diverse technical fields, in particular in automotive engineering. Further development of relays increases the power as well as the voltage of the currents to be switched. Moreover, depending on the area of use, the design is reduced in size. This leads to leakage currents between a magnetic system and a contact system of the electromagnetic relay.

BRIEF SUMMARY

It is an object of the invention to provide a relay wherein the relay has a small design and a small leakage current between a magnetic system and a contact system of the relay.

This and other objects are achieved by a relay comprising a magnetic system provided with an armature and a contact system provided with a first contact and a moveable second contact. An electrically insulating base plate is arranged between the magnetic system and the contact system and has an opening therein. An actuator extends between the armature and the contact system through the opening and transfers movement of the armature to the second contact to move the second contact into electrical engagement with the first contact. A first wall is arranged between the opening and the magnetic system or the opening and the contact system and extends a leakage path of an electrical leakage current between the contact system and the magnetic system.

This and other objects are further achieved by a relay comprising a magnetic system provided with an armature and a contact system provided with a first contact and a moveable second contact. An electrically insulating base plate is arranged between the magnetic system and the contact system and has an opening therein. First and second walls extend from the base plate and are arranged between the opening and the magnetic system or the opening and the contact system. An actuator extends between the armature and the contact system through the opening and transfers movement of the armature to the second contact to move the second contact into electrical engagement with the first contact. The actuator has a third wall that extends toward the base plate and between the first and second walls. The first, second, and third walls extend a leakage path of an electrical leakage current between the contact system and the magnetic system.

DETAILED DESCRIPTION OF THE EMBODIMENT(S)

Figure 1:
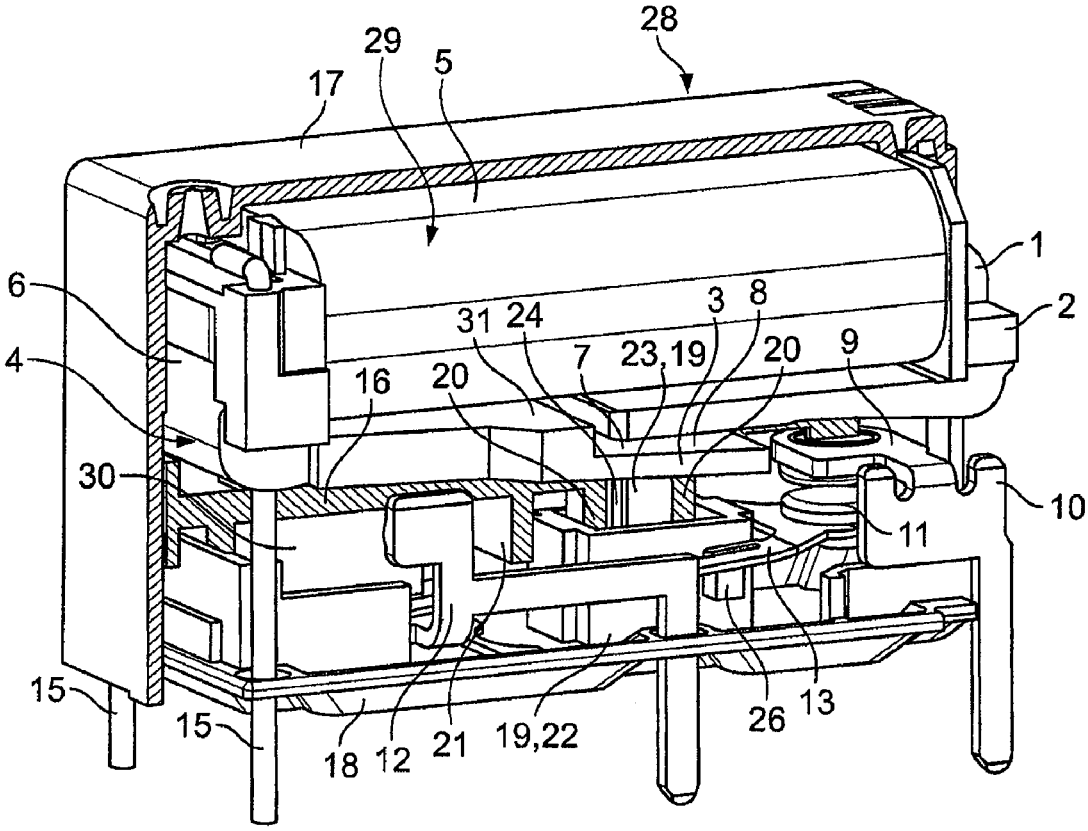
FIG. 1 is a partially cut-open perspective view of a relay according to the invention.
Figure 2:
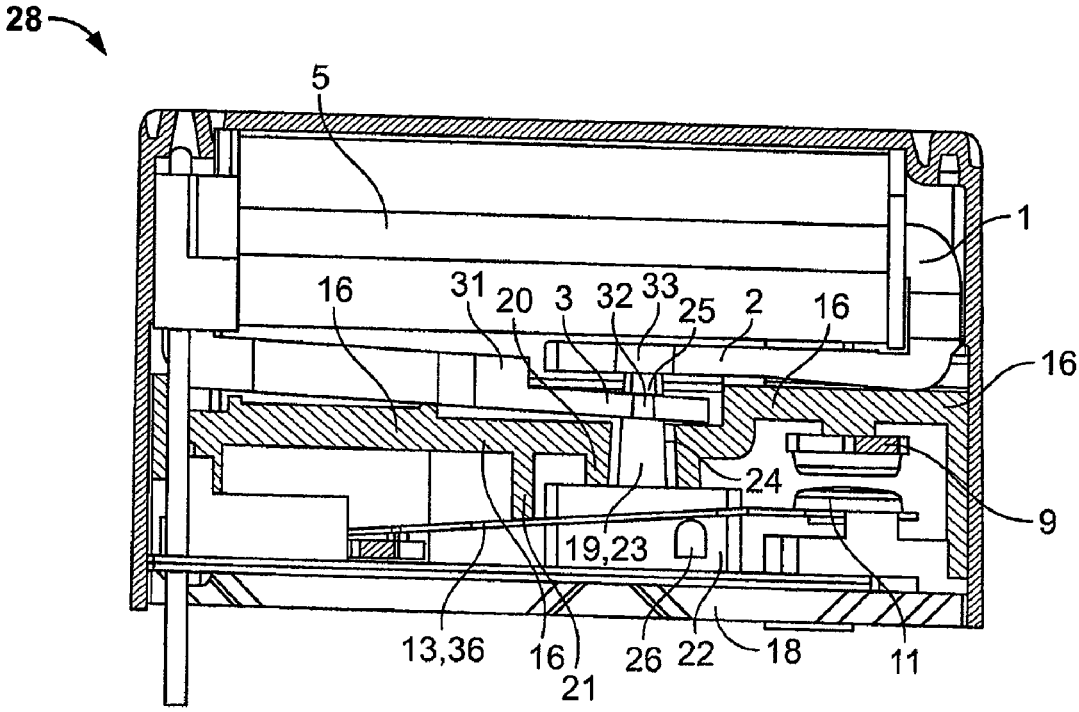
FIG. 2 is a cross-sectional view of the relay of FIG. 1.

FIG. 1 shows a relay 28 according to the invention. As shown in FIG. 1, the relay 28 includes a magnetic system 29 and a contact system 30 separated by a base plate 16 of a housing 40. The magnetic system 29 is located on a first or upper side of the base plate 16 and the contact system 30 is located on a second or bottom side of the base plate 16. The magnetic system 29 has a coil 5 with a core yoke 1 and a substantially L-shaped pole 2. The coil 5 has coil terminals 15 which are guided out of a bottom of the relay 28. As shown in FIG. 2, the pole 2 has a substantially continuous recess 33 formed therein. The pole 2 is guided from one end of the core yoke 1 substantially downward and to about a center of a bottom side of the coil 5. At an end of the coil 5 opposite from the core yoke 1, the coil 5 has an armature bearing 4, as shown in FIG. 1. An armature 3 is pivotally mounted to the armature bearing 4 by a spring 6. The armature 3 is substantially formed as a plate and extends substantially downwards and beyond the center of the bottom side of the coil 5 such that the armature substantially overlaps the pole 2 at an overlapping area 8. The armature 3 has a step 31 arranged in the overlapping area 8. The step 31 thereby reduces the thickness of the armature 3 in the overlapping area 8 contributing to a reduction in the height of the relay. When the armature 3 is not carrying current, the armature 3 is held at a distance from the pole 2 through compression of the spring 6 forming an operating gap 7 at the overlapping area 8. The magnetic system 29 is made, for example, of an electrically conducting material.

The contact system 30 has a first contact 9 fixed to a bottom side of the base plate 16. The first contact 9 is connected to a first contact connection member 10. A moveable second contact 11 is fixed to a contact spring 13 via a contact plate 46. The contact spring 13 is fixed at an end opposite from the second contact 11 to the base plate 16 and a second contact connection member 12. The contact spring 13 is fixed in a first end section 44 to the housing 40 via a plate 48 which presses the contact spring 13 against the base plate 16. The contact spring 13 has two conducting strips 36 which are joined to each other in the first end section 44 and are guided laterally on opposite sides past an actuator 19. In a second end section 45, the conducting strips 36 are joined to a contact plate 46. When the coil 5 is not carrying current, the first and second contacts 9, 11 are positioned at a distance from one another in an open position, as shown in FIGS. 1-2.

Figure 3:
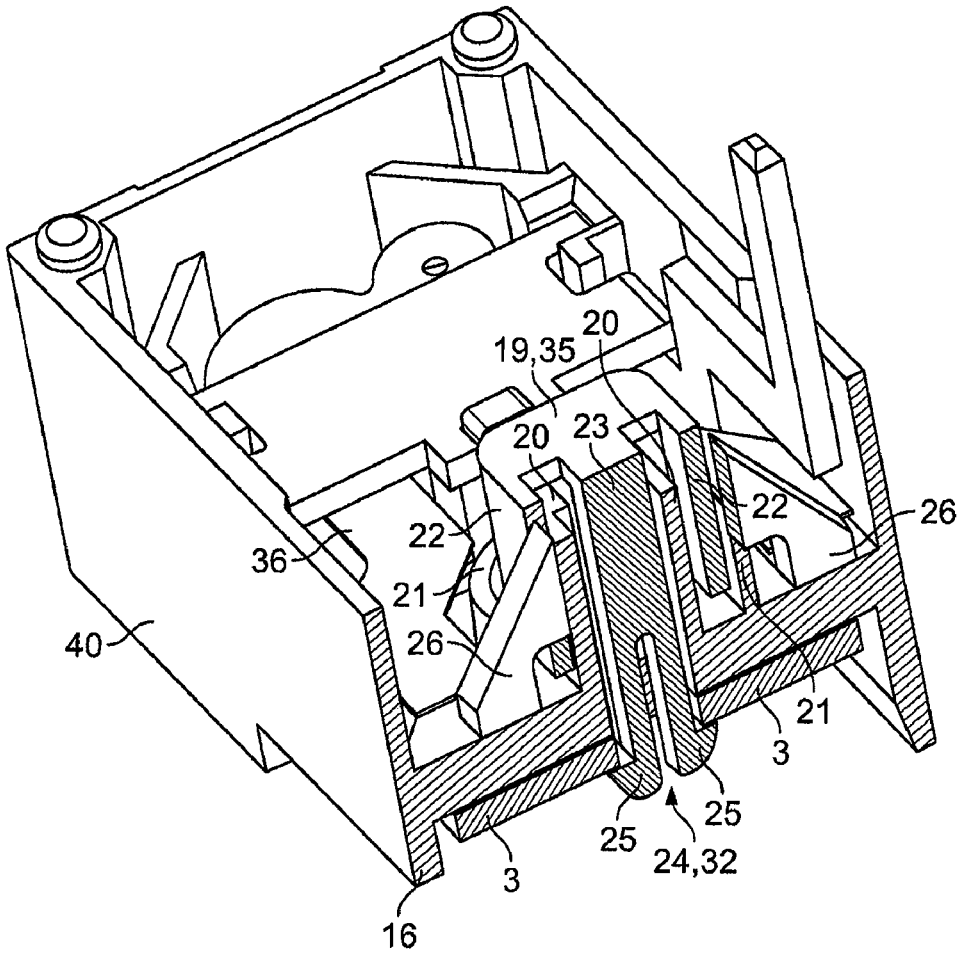
FIG. 3 is a perspective cross-sectional view through an actuator and a housing of the relay of FIG. 1.
Figure 5:
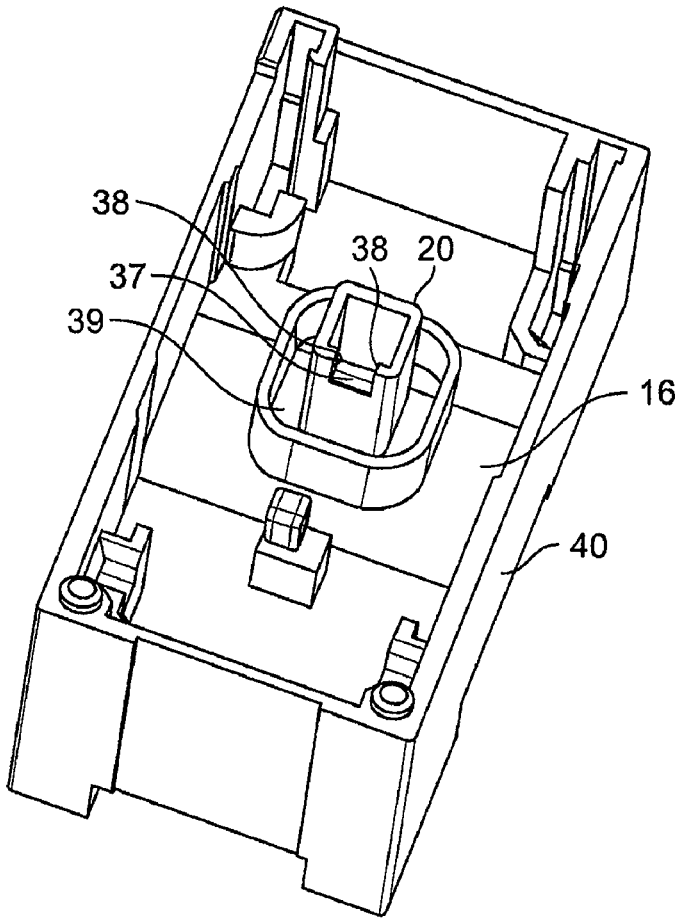
FIG. 5 is a perspective view of a base plate and the first and second walls of the relay of FIG. 1.

The actuator 19 has a holding arm 23. As shown in FIG. 3, the holding arm 23 protrudes through an opening 24 in the base plate 16 and is fixed to the armature 3 by a pair of holding members 25 to connect the contact system 30 to the magnetic system 29. In the illustrated embodiment, the holding members 25 are formed as snap-in hooks that are guided through a second opening 32 in the armature 3 and are locked onto an upper side of the armature 3. An air gap 34 is provided between the holding members 25 so that the actuator 19 can be removed from the armature 3 by bending together the holding members 25. As shown in FIG. 2, the pole 2 has a recess 33 into which the holding members 25 are moved when the armature 3 is attracted to the pole 2. In this way, the armature 3 may be brought to touch the pole 2 in spite of the holding members 25. At an end opposite from the holding members 25, the holding arm 23 has a bottom plate 35. The bottom plate 35 extends laterally beyond a first wall 20, which will be described later. As shown in FIG. 5, assembly apertures 41 are provided at opposite sides of the holding arm 23 on the bottom plate 35. The assembly apertures 41 serve to release the holding members 25 from an extrusion die.

When the coil 5 carries current, the armature 3 is pulled upward toward the pole 2. The actuator 19 is thereby also pulled upward so that the contact spring 13 is taken along by the operating arm 26. The first and second contacts 9, 11 are thereby pulled together to create an electrically conductive connection between the first and second contact connection members 10, 12 is produced. If the current through the coil 5 is switched off again, the armature 3 is moved away from the pole 2 through compression of the spring 6 so that the operating arm 26 of the actuator 19 also moves downward away from the first contact 9. Owing to the spring tension of the contact spring 13, the second contact 11 is consequently separated from the first contact 9 and the electrical connection between the first and second contact connection members 10, 12 is broken. The actuator 19 is made, for example, of an electrically insulating material, such as polyethylene. The contact system 30 is made, for example, of an electrically conducting material.

Due to the small design and insignificant thickness of the base plate 16 of the housing 40, there is the risk of a leakage current forming between the contact system 30 and the magnetic system 29. To reduce the leakage current, the first wall 20 is formed on the bottom side of the base plate 16 and substantially encircles the opening 24. In a further embodiment, the base plate 16 has a second wall 21 located at a distance from the first wall 20 and on the bottom side of the base plate 16. The second wall 21 substantially encircles the first wall 20. The first and second walls 20, 21 have the shape of substantially cylindrical bushes. Depending on the embodiment, the first and/or second walls 20, 21 may be located on different sides of the base plate 16, together on the upper side of the base plate 16, or together on the bottom side of the base plate 16 between the opening 24 and the magnetic system 29. However, when the first and second walls 20, 21 are formed on the same side of the base plate 16, the height of the relay 28 can be reduced.

In the illustrated embodiment, the first and second walls 20, 21 are shaped to match the outer profile of the opening 24 so as to extend a path for the leakage current. The first wall 20 extends higher than the second wall 21 and is substantially formed as a closed annular wall with a substantially rounded rectangular cross-section. The first wall 20 has on a lateral face at an upper edge a notch 37 which is delimited by substantially parallel side guide faces 38. The second wall 21 is at a predetermined distance to the first wall 20 and surrounds the first wall 20 in the shape of a closed annular wall. Although the first and second walls 20, 21 are shown and described as having a particularly shape and position herein, it will be appreciated by those skilled in the art that the shape and position of the first and/or second walls 20, 21 may be varied as long as the leakage-current path between the contact system 30 and the magnetic system 29 is extended via the opening 24. For example, the first and second walls 20, 21 may be straight or angled. The housing 40 and the base plate 16 may made, for example, from an electrically insulating material, such as polyethylene.

Figure 8:
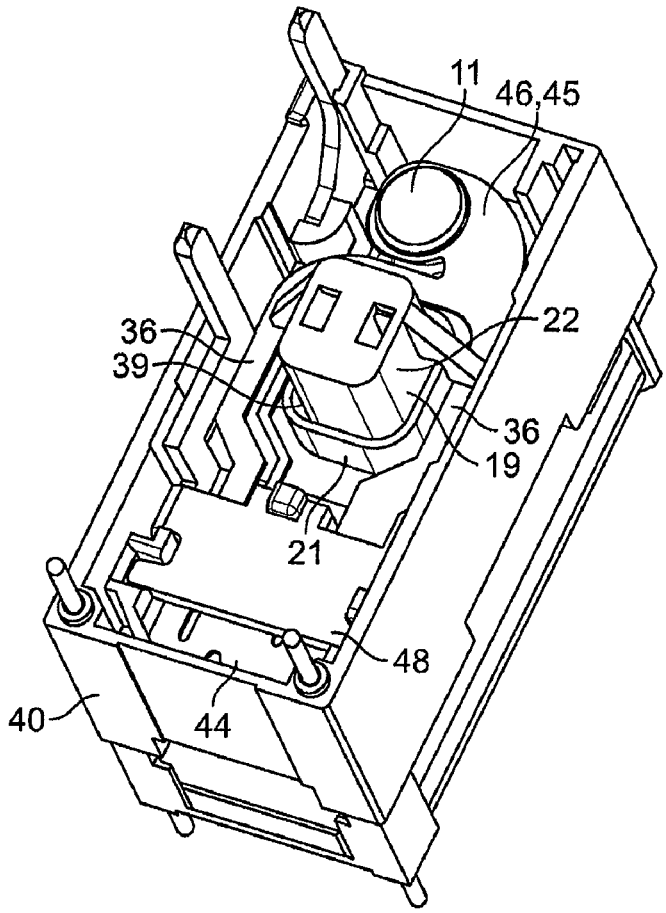
FIG. 8 is a perspective view of a contact system and an actuator of the relay of FIG. 1.

In a further embodiment, the actuator 19 has a third wall 22 which laterally overlaps the first and/or second walls 20, 21. The third wall 22 extends from both sides of the bottom plate 35 of the holding arm 23 in the direction of the base plate 16. In one embodiment, the third wall 22 reaches almost as far as the base plate 16 and is a short lateral distance from the first or second wall 20, 21. For example, the third wall 22 may almost touch the first or second wall 20, 21. In the embodiment with the first and second walls 20, 21 on the same side of the base plate 16, the first and second walls 20, 21 are at a fixed distance from the opening 24. The third wall 22 is formed in a substantially annular space 39 between the first and second walls 20, 21 and laterally overlaps the first and second walls 20, 21, as shown in FIGS. 3, 5, and 8. The third wall 22 may have a shape the same as or different than the shape of the first and/or second walls 20, 21. The third wall 22 may, for example, have the shape of a substantially flat plate, bent plate, partial bush, or cylindrical bush.

Figure 6:
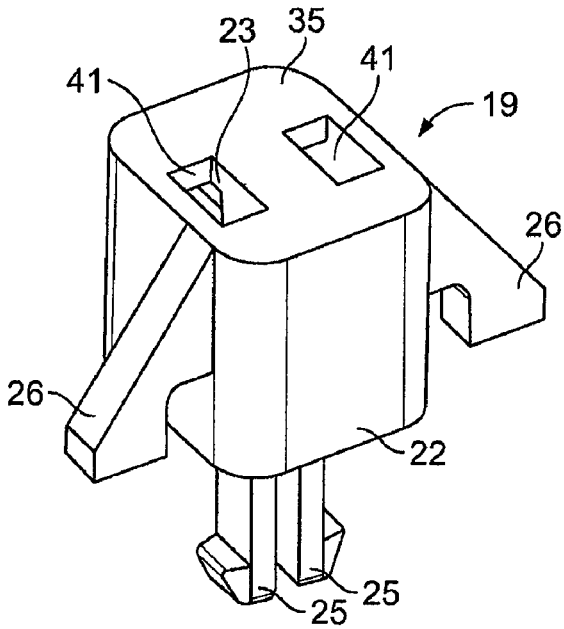
FIG. 6 is a perspective view of the actuator.
Figure 7:
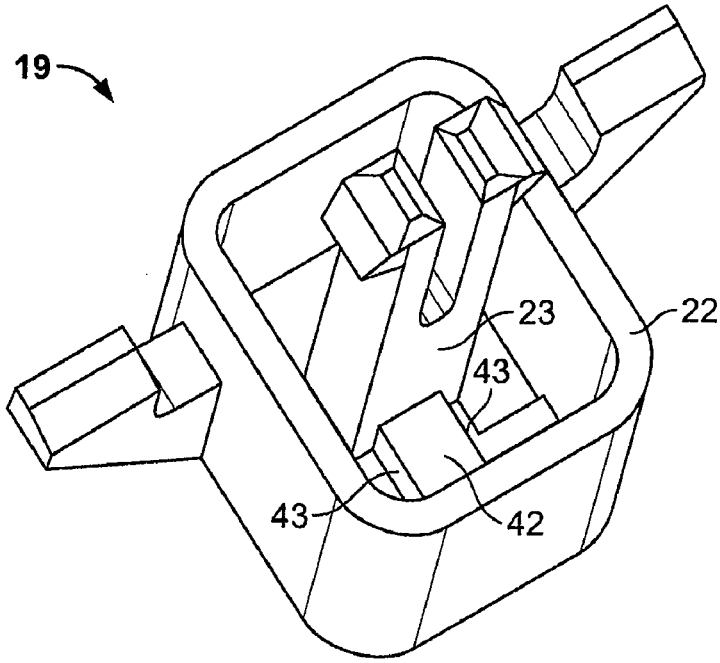
FIG. 7 is another perspective view of the actuator.

As shown in FIG. 6, at opposite outsides of the third wall 22, operating arms 26 are formed which protrude laterally from the third wall 22 and are guided in a direction of conducting strips 36 of the contact spring 13. In a rest position, the operating arms 26 rest on the conducting strips 36. In a lower area, the operating arms 26 are formed at a distance from the third wall 22 so that when the armature 3 is actuated and the actuator 19 is moved towards the base plate 16 there is sufficient space available for the second wall 21. As shown in FIG. 7, a guide 42 is formed on the bottom plate 35 which has guide faces 43 on opposite sides thereof. When assembled, the guide 42 is inserted into the notch 37 of the first wall 20 and the guide faces 43 are guided through the side guide sides 38 to enable precise guidance of the actuator 19. As shown in FIG. 1, the relay 28 is substantially enclosed by a cover 17 and a cover bottom 18.

Figure 4:
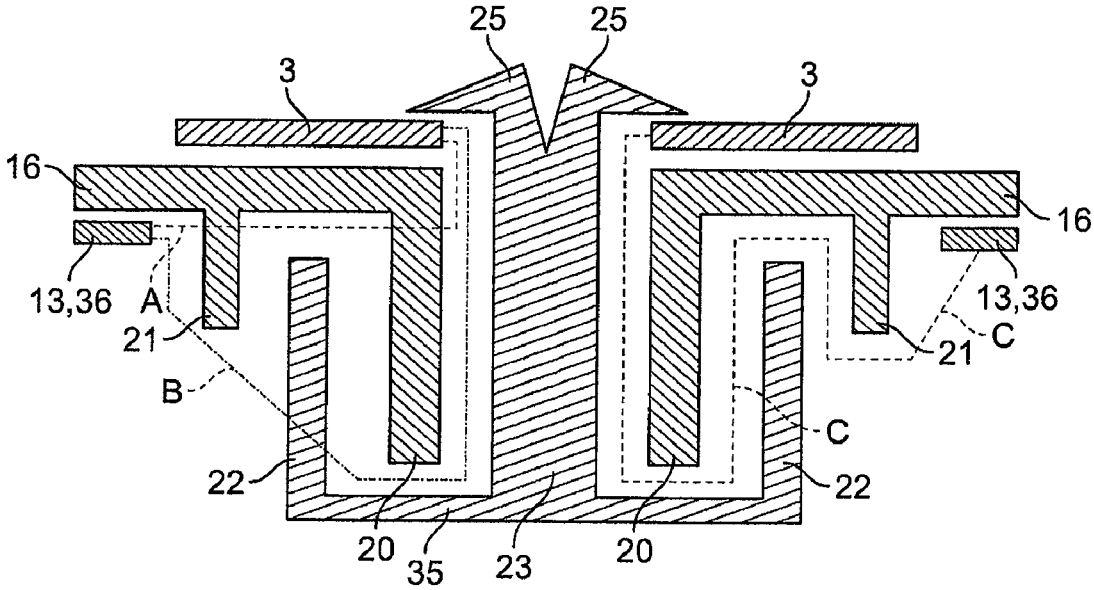
FIG. 4 is a schematic diagram of a leakage path shown with and without the presence of first, second and third walls in the relay of FIG. 1.

FIG. 4 shows in a schematic diagram of a theoretic leakage path within the relay 28. Dashed line A shows the leakage path in the relay 28 when the relay 28 is formed without the first, second and third walls 20, 21, 22. Dotted and dashed line B shows the leakage path in the relay 28 when the relay 28 is formed without the third wall 22. Dashed line C shows the leakage path in the relay 28 when the relay 28 is formed with the first, second and third walls 20, 21, 22. It is obvious from this diagram that the first, second and third walls 20, 21, 22 markedly extend of the leakage path in the relay 28. Thus, the leakage current is reduced in accordance with the invention by extending the leakage-current path by providing at least the first wall 20 on the base plate 16 between the opening 24 and the contact system 30 or the magnetic system 29. By forming at least the first wall 20 in the relay 28, the leakage-current path between the magnetic system 29 and the contact system 30 is extended. Additionally, the third wall 22 prevents, in the case of a narrow spacing between the first and second walls 20, 21, a current from jumping over the first and second walls 20, 21, thereby reducing the leakage-current path. This enables the distance between the first and second walls 20, 21 to be made relatively short. Further, because the first, second, and third walls 20, 21, 22 are designed as closed annular walls, the leakage current is extended by the circumference of the entire opening.

Figure 9:
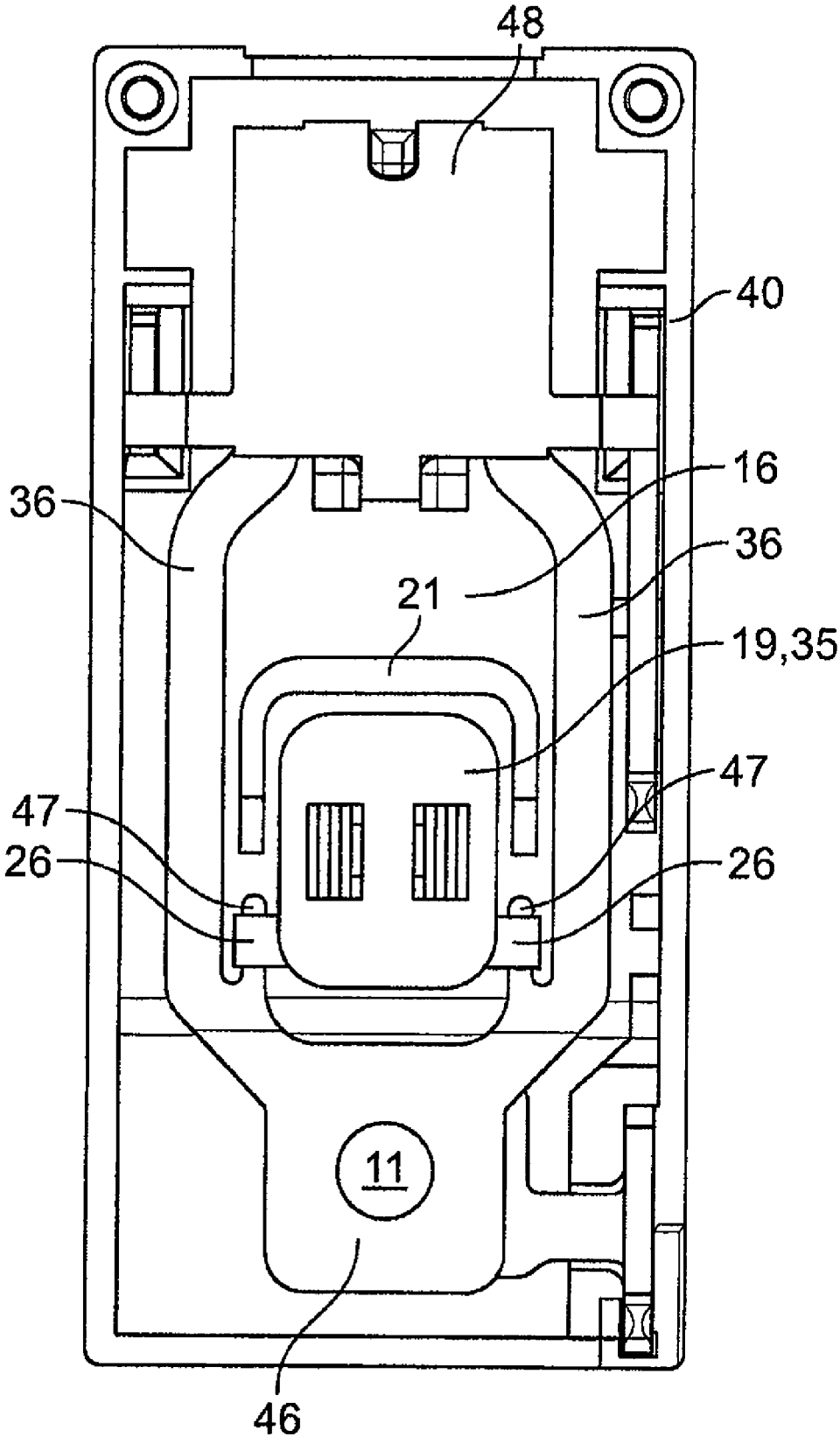
FIG. 9 is a plan view of an alternate embodiment of the contact system and the second wall.

FIG. 9 shows an alternate embodiment of the relay 28. In the alternate embodiment of the relay 28, the second wall 21 is formed substantially as a partially annular wall with a substantially U-shaped cross-section. The first wall 20 may additionally be formed as a substantially partially annular wall with a substantially U-shaped cross-section. The partially annular first and second walls 20, 21 are located so that particularly critical areas between the magnetic system 2 and the contact system 30 are extended in relation to the leakage-current path. Moreover, extensions 47 are formed on opposite sides of the conducting strips 36. The extensions 47 extend from the conducting strip 36 inwards in a direction of the actuator 19. The extensions 47 are guided underneath the operating arms 26 and serve as support members for the operating arms 26. The extensions 47 enable the conducting strips 36 to be guided at a greater distance from the opening 24 while providing a support for the operating arms 26 near the opening 24 thereby reducing the risk of a leakage current developing.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A relay, comprising:

a magnetic system provided with an armature;

a contact system provided with a first contact and a moveable second contact;

an electrically insulating base plate arranged between the magnetic system and the contact system, the base plate having an opening therein;

an actuator extending between the armature and the contact system through the opening, the actuator transferring movement of the armature to the second contact to move the second contact into electrical engagement with the first contact; and a first wall arranged between the opening and the contact system that extends a leakage path of an electrical leakage current between the contact system and the magnetic system;

wherein the base plate comprises a second wall arranged between the opening and the contact system that extends the leakage path of the electrical leakage current between the contact system and the magnetic system, the second wall extends from the base plate and is arranged on the same side of the base plate as the first wall;

wherein the second wall being spaced from and substantially surrounding the first wall.

2. The relay of claim 1, wherein the first wall extends from the base plate.

3. The relay of claim 1, wherein the first wall substantially annularly surrounds opening.

4. The relay of claim 1, wherein the actuator includes a pair of holding members fixed to the armature.

5. The relay of claim 1, wherein the first wall has a greater height than the second wall.

6. The relay of claim 1, wherein operating arms protrude from the actuator, the operating arms transferring the movement of the armature to the second contact.

7. The relay of claim 6, wherein the second contact includes a contact spring, the contact spring having a conducting strip with an extension, the extension providing support for the operating arms.

8. The relay of claim 1, further comprising a third wall that laterally overlaps the first wall.

9. The relay of claim 1, wherein the actuator is guided by the first wall.

10. A relay, comprising:

a magnetic system provided with an armature;

a contact system provided with a first contact and a moveable second contact;

an electrically insulating base plate arranged between the magnetic system and the contact system, the base plate having an opening therein;

first and second walls extending from the base plate, the first and second walls arranged between the opening and the contact system;

an actuator extending between the armature and the contact system through the opening, the actuator transferring movement of the armature to the second contact to move the second contact into electrical engagement with the first contact, the actuator having a third wall that extends toward the base plate and between the first and second walls; and the first, second, and third walls extending a leakage path of an electrical leakage current between the contact system and the magnetic system.

11. The relay of claim 10, wherein the actuator includes a pair of holding members fixed to the armature.

12. The relay of claim 10, wherein the third wall laterally overlaps the first wall.

13. The relay of claim 10, wherein the first wall has a height greater than the second wall.

14. The relay of claim 10, wherein the first, second, and third walls have a substantially annular shape.

15. The relay of claim 10, wherein the actuator contacts the first wall and is guided thereby.

16. The relay of claim 10, wherein operating arms protrude from the third wall, the operating arms transferring the movement of the armature to the second contact.

17. The relay of claim 16, wherein the second contact includes a contact spring, the contact spring having a conducting strip with an extension, the extension providing support for the operating arms.

* * * * *